US011085716B2

(12) United States Patent
Zhang

(10) Patent No.: US 11,085,716 B2
(45) Date of Patent: Aug. 10, 2021

(54) MAGAZINE SLEEVE

(71) Applicant: Cytac Technology Limited, Shenzhen (CN)

(72) Inventor: Yong Zhang, Shenzhen (CN)

( * ) Notice: Subject to any disclaimer, the term of this patent is extended or adjusted under 35 U.S.C. 154(b) by 35 days.

(21) Appl. No.: 16/662,038

(22) Filed: Oct. 24, 2019

(65) Prior Publication Data

US 2020/0393209 A1 Dec. 17, 2020

(30) Foreign Application Priority Data

Jun. 11, 2019 (CN) ..... 201910503744.8

(51) Int. Cl.
*F41A 9/63* (2006.01)
*F41A 17/38* (2006.01)

(52) U.S. Cl.
CPC ..... *F41A 9/63* (2013.01); *F41A 17/38* (2013.01)

(58) Field of Classification Search
CPC .... F41A 17/38; F41A 9/63; F41A 9/64; F41A 9/65; F41A 9/67; F41A 9/68; F41A 9/69; F41A 9/71
See application file for complete search history.

(56) References Cited

U.S. PATENT DOCUMENTS

| | | | | |
|---|---|---|---|---|
| 6,202,908 | B1 * | 3/2001 | Groover | F42B 39/02 224/236 |
| 7,497,043 | B2 * | 3/2009 | Clifton, Jr. | F41A 9/63 224/239 |
| 8,887,972 | B2 * | 11/2014 | Solomon | A45F 5/021 224/245 |
| 9,982,964 | B1 * | 5/2018 | Beard | F41C 33/048 |
| 10,274,296 | B2 * | 4/2019 | Tedder | F42B 39/02 |
| 10,571,220 | B2 * | 2/2020 | Toschi | F41C 33/04 |
| 10,724,820 | B1 * | 7/2020 | Zhang | F41A 35/02 |
| 2017/0099934 | A1 * | 4/2017 | Evans | A45F 5/02 |

* cited by examiner

*Primary Examiner* — Derek J Battisti
(74) *Attorney, Agent, or Firm* — HYIP

(57) ABSTRACT

A magazine sleeve, including: a fixing member, which is a sleeve case having a U-shaped cavity, and a notch of the adjusting member is arranged at the opening of the sleeve case, and an adjusting slide is disposed at the notch of the adjusting member and perpendicular to a back plate of the notch of the adjusting member, and a through hole is provided with a connecting rod on the back plate; the adjusting member, is a U-shaped slot buckle plate which is located at the notch of the adjusting member. An elastic slide of the U-shaped slot buckle plate matches with the adjusting slide of the back plate, and an adjusting receiving cavity of the magazine is formed when the U-shaped slot buckle plate cooperates with the back plate.

7 Claims, 5 Drawing Sheets

MAGAZINE SLEEVE

TECHNICAL FILED

The present application relates to the technical field of security equipment, and in particular to a magazine sleeve.

BACKGROUND

The magazine is a kind of feeding device, and it is installed in a certain direction of the circumference of the axis of the gun machine. It is generally detachable and has a box shape. The function of the magazine is the same as that of the bullet drum, the bullet disk, etc. The magazine spring and the magazine follower work together to push out the bullets one by one for supplying bullet to the weapons. The main function of the magazine is to accommodate the bullets, to timely deliver the bullets during the shooting, and to regulate the bullet loading position, which usually consists of the magazine body, the magazine follower, the magazine spring and the magazine cover.

The separate magazine is not easy to carry, and generally needs to be accommodated in the magazine sleeve. The magazine sleeve can provide space and protect for the magazine, and can be worn and carried, which is convenient for the placement of the magazine. At the same time, it is also the basic requirement for the magazine sleeve that the magazine should be quickly and safely taken from the magazine sleeve, and does not affect the personnel's actions. The existing magazine sleeve adopts a buckle-type engagement, and the magazine is engaged in the magazine sleeve, and the engagement and release of the magazine are achieved by locking the buckle or unlocking the buckle. The locking buckle of the magazine sleeve is inconvenient to use. If the buckle is too tight, the magazine is not easy to release. If the buckle is too loose, the magazine cannot be well engaged. The operator has to lock the buckle after the locking buckle is aligned when the buckle is locking, and the operation is inconvenient. If the lock is not locked tightly, the magazine is easy to fall, which cases a safety hazard.

Therefore, how to provide a magazine that is quickly convenient to put and take and with strong stability and high safety is a technical problem to be solved in the field. The magazine sleeves on the market can only be applied to a magazine of a certain size, and in this application, the magazine sleeve can be adjusted to fit for a variety of magazines.

SUMMARY

The object of the present application is to provide a magazine sleeve to solve the technical problem that there is no easy and fast pick-up, high stability and high security magazine in the prior art.

To realize above objects, a magazine sleeve is provided by the present application, including: a fixing member, an adjusting member and a connecting rod; wherein the fixing member, is a sleeve case having a U-shaped cavity, and the magazine is received in the U-shaped cavity, and a notch of the adjusting member is disposed at an opening of the sleeve case, and an adjusting slide is disposed at the notch of the adjusting member, the adjusting slide is perpendicular to a back plate of the notch of the adjusting member, and a through hole is provided with a connecting rod on the back plate;

the adjusting member, is a U-shaped slot buckle plate which is located at the notch of the adjusting member; an elastic slide of the U-shaped slot buckle plate matches with the adjusting slide of the back plate, and the U-shaped slot buckle plate cooperates with the back plate to form an adjusting receiving cavity of the magazine; an elastic piece facing the back plate is arranged on the adjusting member, and a fastening adjusting hole corresponding to the through hole is provided at the U-shaped slot buckle plate;

the connecting rod, penetrates the through hole and the fastening adjusting hole to combine the adjusting member and the fixing member to form a receiving cavity of the magazine, and a distance between the adjusting member and the back plate is adjusted by adjusting an elastic thread fit of the connecting rod and fastening adjusting hole.

Optionally, wherein the elastic piece is an elastic piece that is internal convex toward the back plate, and the distance between the adjusting member and the back plate is adjusted to make a magazine contained in the receiving chamber compressed or decompressed by the elastic piece.

Optionally, the magazine sleeve further comprises an elastic mechanism, wherein the elastic mechanism is located on the connecting rod between the fixing member and the adjusting member to provide elastic support facing the receiving cavity outwardly.

Optionally, wherein the elastic mechanism is a spring.

Optionally, wherein a slot is disposed outside the fixing member, and a buckle is disposed at a position outside the adjusting member and corresponding to the slot; the buckle is an internal convex elastic piece facing the receiving cavity, and a buckle tooth matching with the slot is disposed on an inner protrusion of the buckle; and the buckle cooperates with the slot to fix a position of the adjusting member and a position of the fixing member.

Optionally, wherein two or more slots are provided in a direction in parallel from the fixing member to the adjusting member.

Optionally, wherein the magazine sleeve further comprises a support plate and a fixing disc; wherein the fixing disc is disposed outside the back plate of the fixing member, and the fixing disc is a convex fluted disc, a convex fluted disc is provided with protruding teeth, and a groove is arranged between every two adjacent protruding teeth;

a corresponding convex fluted disc is disposed at a position where the support plate corresponds to the fixing disc, and the support plate and the fixing disc are connected by an adjusting rod, and the grooves are coupled with the protruding teeth to connect the fixing disc with the support plate together;

the adjusting rod between the support plate and the fixing disc is loosened, and the protruding teeth of the fixing disc are loosened from the grooves of the support plate to adjust a position of the fixing disc.

Optionally, wherein the fixing member comprises two or more U-shaped cavities; the adjusting member comprises two or more U-shaped slots, the adjusting member cooperates with the fixing member to form two or more receiving cavities of the magazine.

The effect of the magazine sleeve of the present application is as follows:

(1) The magazine sleeve of the present application forms a receiving cavity for magazine sleeve case by a fixing member and an adjusting member, and a magazine is accommodated in the receiving cavity of the magazine sleeve case, and the distance between the adjusting member and the fixing member can be adjusted, thereby adjusting the cavity size of the receiving cavity on the opening, further combined with the elastic piece on the magazine sleeve case to compress or release the magazine, thereby realizing the fastening storage and release of the magazine, so that the user can quickly put or take the magazine.

(2) The magazine sleeve of the present application is formed by the fixing member and the adjusting member to form two or more receiving cavities for magazine sleeve case, and the distance between the adjusting member and the fixing member can be simultaneously adjusted to control the opening size of the receiving cavities, so that the elastic piece is compressed or released the magazine, and the adjusting member is matched with the buckle and the slot on the outer side of the fixing member to further tighten the engagement of the magazine, thereby improving the safety and stability of the magazine sleeve for receiving the magazine.

BRIEF DESCRIPTION OF THE DRAWINGS

In order to more clearly illustrate the embodiments of the present application or the technical solutions in the prior art, the drawings to be used in the embodiments or the prior art description will be briefly described below. It is obvious that the drawings in the following description are only some of the embodiments described in this application, and other drawings can be obtained by the skilled in the art according to these drawings.

DETAILED DESCRIPTION OF THE EMBODIMENTS

The technical solutions in the embodiments of the present application are clearly and completely described in the following with reference to the accompanying drawings in the embodiments of the present application. It is obvious that the described embodiments are a part of the embodiments of the present application, and not all of the embodiments. All other embodiments obtained by a person skilled in the art based on the embodiments of the present application without creative efforts are within the scope of the present application.

Embodiment 1

Figure 1:
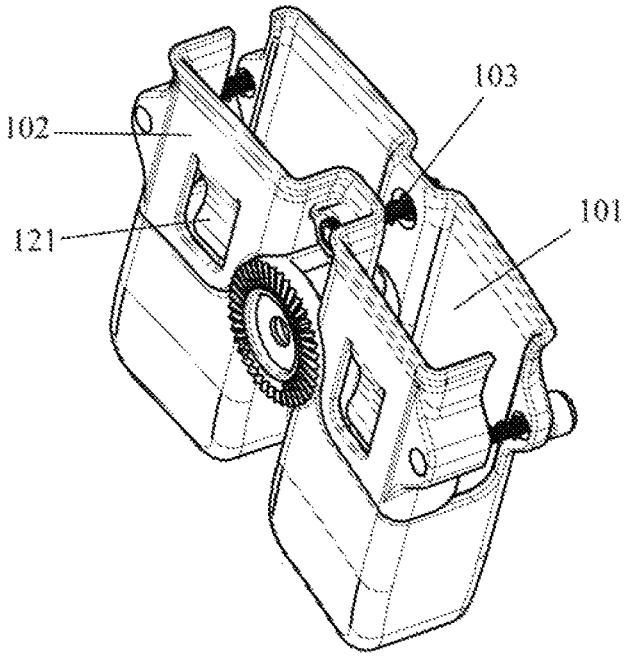
FIG. 1 is a schematic structural view of a magazine sleeve according to an embodiment of the present application.
Figure 2:
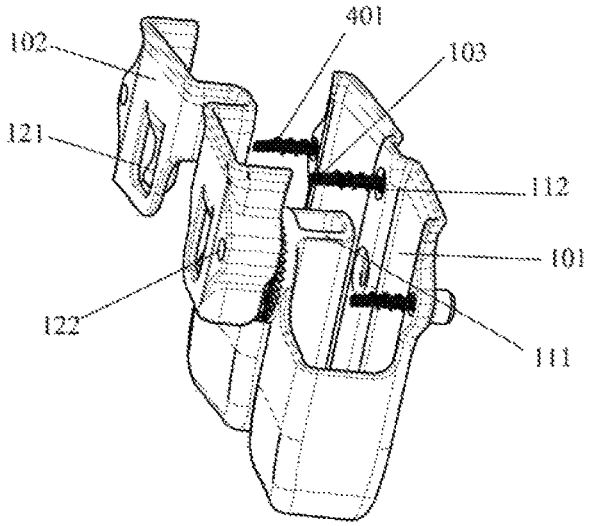
FIG. 2 is a schematic view showing a split structure of the magazine sleeve in FIG. 1 according to an embodiment of the present application.
Figure 3:
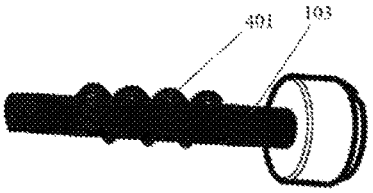
FIG. 3 is a schematic structural view of a connecting rod of FIG. 1 according to an embodiment of the present application.
Figure 4:
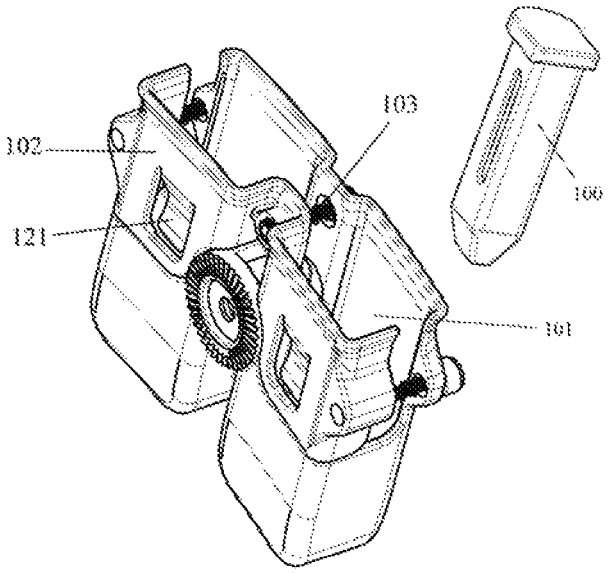
FIG. 4 is a schematic view of a magazine and the magazine sleeve of FIG. 1 according to an embodiment of the present application.
Figure 5:
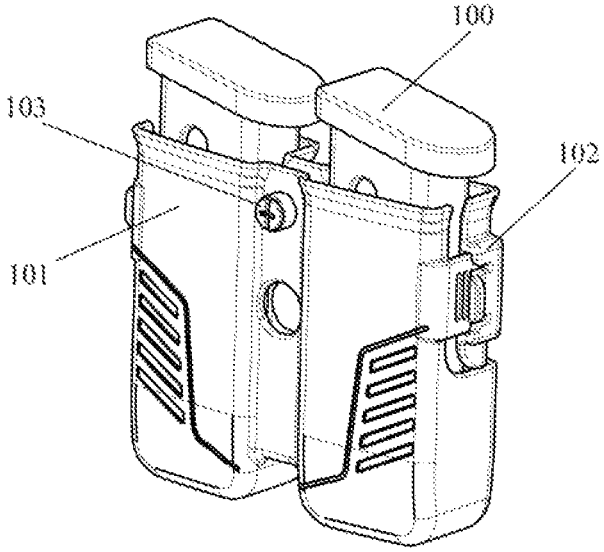
FIG. 5 is a schematic view of the magazine being loaded into a magazine sleeve in FIG. 1 according to an embodiment of the present application.
Figure 6:
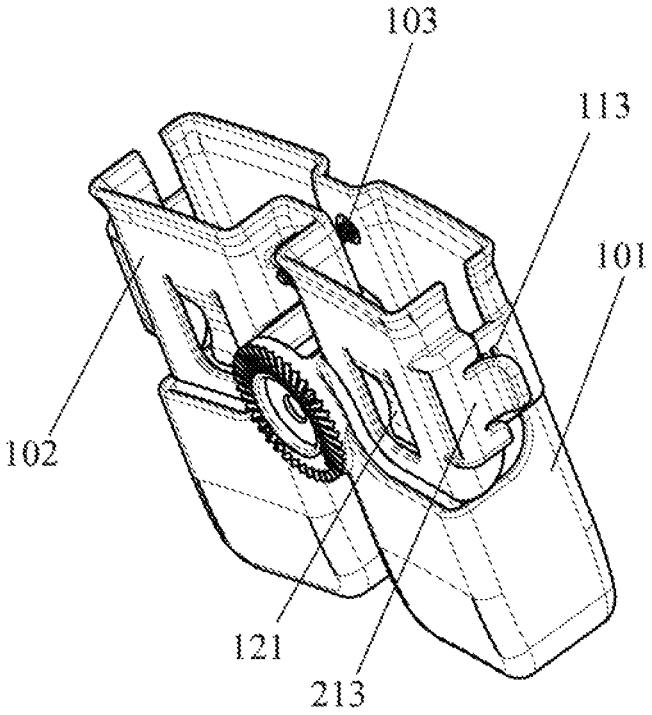
FIG. 6 is a schematic structural view of another magazine sleeve according to an embodiment of the present application.

As shown in FIG. 1 to FIG. 5, FIG. 1 is a schematic structural view of a magazine sleeve in the present embodiment; FIG. 2 is a schematic structural view of a split structure of the magazine sleeve in FIG. 1 according to the present embodiment; FIG. 3 is a schematic structural view of the connecting rod of FIG. 1; FIG. 4 is a schematic view of the magazine and the magazine sleeve of FIG. 1 in the present embodiment; FIG. 5 is a schematic view of the magazine being loaded into the magazine sleeve of FIG. 1. The magazine sleeve includes a fixing member 101, an adjusting member 102 and a connecting rod 103.

Wherein, the fixing member 101 is a sleeve case having a U-shaped cavity, and the magazine is received in the U-shaped cavity, and a notch of the adjusting member is disposed at an opening of the sleeve case, and an adjusting slide 111 is disposed at the notch of the adjusting member, the adjusting slide is perpendicular to a back plate of the notch of the adjusting member, and a through hole 112 is provided with a connecting rod on the back plate.

The adjusting slide has a guiding position for adjusting the adjusting member to slide on the fixing member, so that the adjusting member can smoothly move in a direction from the adjusting member to the fixing member, thereby fastening or loosening the magazine.

The adjusting member 102 is a U-shaped slot buckle plate which is located at the notch of the adjusting member. An elastic slide of the U-shaped slot buckle plate matches with the adjusting slide of the back plate, and the U-shaped slot buckle plate cooperates with the back plate to form an adjusting receiving cavity of the magazine. An elastic piece 121 facing the back plate is arranged on the adjusting member, and a fastening adjusting hole 122 corresponding to the through hole is provided at the U-shaped slot buckle plate.

The connecting rod 103 penetrates the through hole and the fastening adjusting hole to combine the adjusting member and the fixing member to form a receiving cavity of the magazine, and a distance between the adjusting member and the back plate is adjusted by adjusting an elastic thread fit of the connecting rod and fastening adjusting hole.

In an alternative embodiment, the left and right side guards of the fixing member corresponding to the adjusting member (the side guards parallel to the adjusting slide) and the left and right side guards of the adjusting member may also be arranged in an adjustable form. A corresponding slide is provided therebetween to guide the left and right side guards in the direction of the slide. The left and right side guards are fastened with the front and rear side guards of the fixing member/adjustment member by the connecting rods. An elastic mechanism such as a spring is disposed on the connecting rod between the left and right side guards and the front and rear side guard walls to provide an elastic support force to the outer side, and the threaded connecting rod can be adjusted with the thread adjusting hole on the side wall of the front and rear side guards to adjust the distance between the left and right side guard wall to the side wall of the front and rear side guards, thereby realizing the adjustment of receiving width of the magazine sleeve in the width direction of the magazine, and can accommodate magazines of different widths.

In an alternative embodiment, the elastic piece is an elastic piece that is internal convex toward the back plate, and the distance between the adjusting member and the back plate is adjusted to make a magazine contained in the receiving chamber compressed or decompressed by the elastic piece. When the connecting rod is adjusted to drive the adjusting member to move toward the fixing member, the protrusion of the elastic piece on the adjusting member presses the magazine. And when the connecting rod is adjusted to drive the adjusting member to move in the direction away from the fixing member, the pressure of the magazine will be released by the protrusion of the elastic piece on the adjusting member, so as to make the magazine loose.

In an alternative embodiment, as shown in FIG. 3, the magazine sleeve may further include an elastic mechanism 401, and the elastic mechanism is located on the connecting rod between the fixing member and the adjusting member to provide elastic support facing the receiving cavity outwardly. Optionally, the elastic mechanism is a spring.

In an alternative embodiment, the bottom surface of the U-shaped cavity of the fixing member may be provided as an adjustable bottom guard, and the bottom guard is fastened connected to the side wall of the sleeve case of the U-shaped cavity through the connecting rod. An elastic mechanism such as a spring is located on the connecting rod between the side wall of the sleeve case of the U-shaped cavity and the bottom guard to provide an elastic support force to the outside, the threaded connecting rod and the threaded adjusting hole on the side wall of the sleeve case of the U-shaped cavity can corporate to adjust the distance between the bottom guard and the side wall of the sleeve case of the U-shaped cavity, thereby realizing the adjustment of receiving length of the magazine sleeve in the insertion direction of the magazine, and can accommodate the magazine of different lengths.

Figure 7:
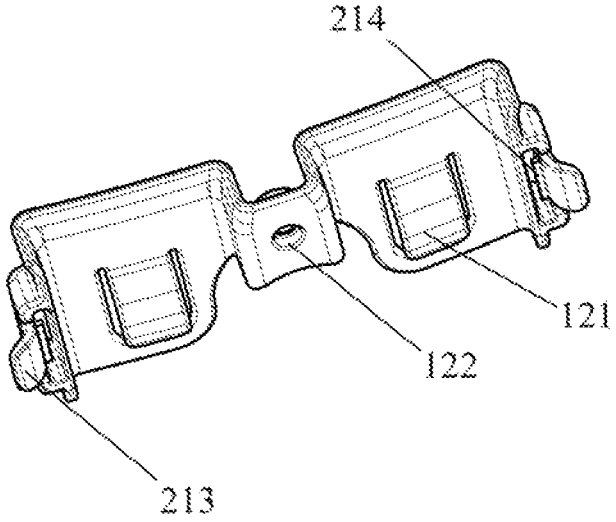
FIG. 7 is a schematic structural view of an adjusting member of the magazine sleeve in FIG. 6 according to an embodiment of the present application.
Figure 8:
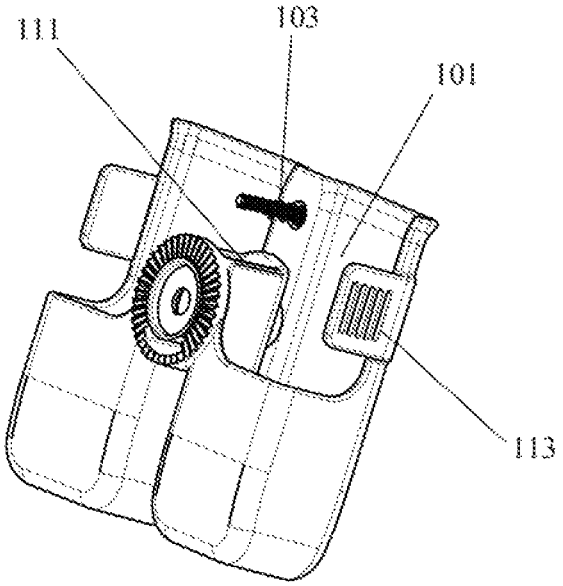
FIG. 8 is a schematic structural view of a fixing member of the magazine sleeve in FIG. 6 according to an embodiment of the present application.
Figure 9:
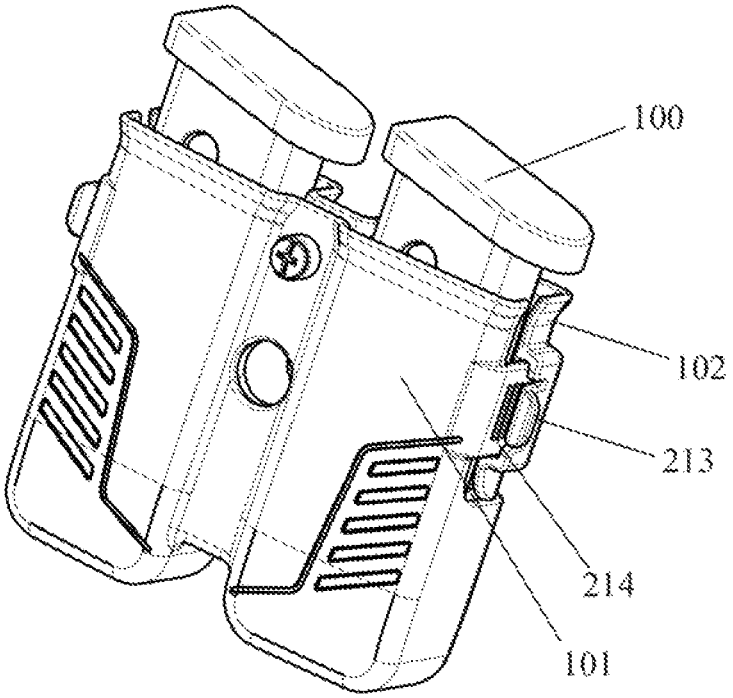
FIG. 9 is a schematic view showing the magazine being loaded into the magazine sleeve in FIG. 6 according to an embodiment of the present application.

In some alternative embodiments, as shown in FIG. 6 to FIG. 9, FIG. 6 is a schematic structural view of another magazine sleeve in the embodiment; FIG. 7 is a schematic structural view of the adjusting member of the magazine sleeve in FIG. 6; FIG. 8 is a structural schematic view of the fixing member of the magazine sleeve of FIG. 6; FIG. 9 is a schematic view of the magazine of FIG. 6 being loaded into the magazine sleeve. What is different from the magazine as shown in FIG. 1 is that a slot 113 is disposed outside the fixing member 101, and a buckle 213 is disposed at a position outside the adjusting member and corresponding to the slot; the buckle is an internal convex elastic piece facing the receiving cavity, and a buckle tooth 214 matching with the slot is disposed on an inner protrusion of the buckle; and the buckle cooperates with the slot to fix a position of the adjusting member and a position of the fixing member.

Optionally, two or more slots 113 are provided in a direction in parallel from the fixing member to the adjusting member. And the slots may be disposed on the side ears, and the side ears are located on the two sides of the fixing member corresponding to the buckle of the adjusting member.

Figure 10:
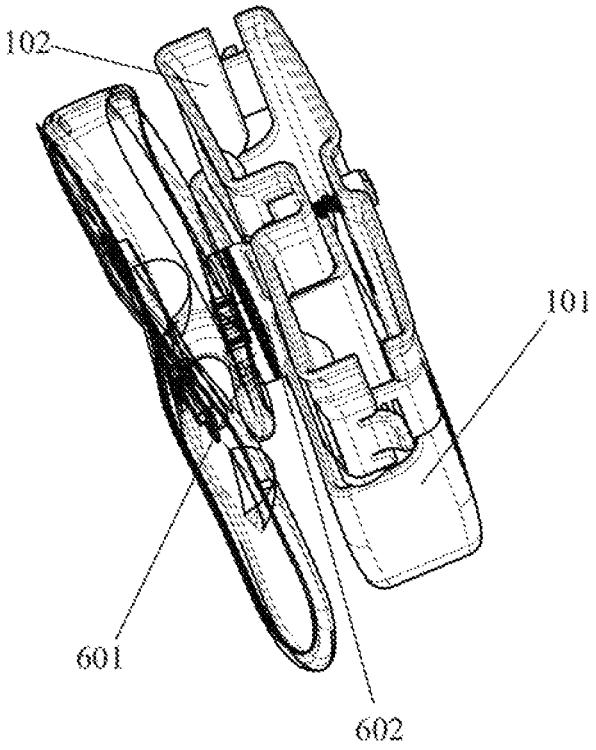
FIG. 10 is a schematic structural view of another magazine sleeve according to an embodiment of the present application.

In an alternative embodiment, as shown in FIG. 10, FIG. 10 is a schematic structural view of another type of magazine sleeve in the embodiment. In contrast to FIG. 1, the magazine sleeve further includes: a support plate 601 and a fixing disc 602. Wherein the fixing disc is disposed outside the back plate of the fixing member, and the fixing disc is a convex fluted disc, a convex fluted disc is provided with protruding teeth, and a groove is arranged between every two adjacent protruding teeth.

A corresponding convex fluted disc is disposed at a position where the support plate corresponds to the fixing disc, and the support plate and the fixing disc are connected by an adjusting rod, and the grooves are coupled with the protruding teeth to connect the fixing disc with the support plate together. The adjusting rod between the support plate and the fixing disc is loosened, and the protruding teeth of the fixing disc are loosened from the grooves of the support plate to adjust a position of the fixing disc.

In an alternative embodiment, the fixing member includes two or more U-shaped cavities; the adjusting member includes two or more U-shaped slots, and the adjusting member cooperates with the fixing members to form two or more receiving cavity of the magazine.

While the preferred embodiment of the present application has been described, it will be apparent that those skilled in the art can make further changes and modifications to the embodiments based on the basic creative concept. Therefore, the appended claims are intended to be interpreted as including the preferred embodiments and the modifications within the scope of the present application. It will be apparent to those skilled in the art that various modifications and changes can be made in the present application without departing from the spirit and scope of the application. Thus, if these modifications and variations of this application fall within the scope of the claims of this application, the application is also intended to include these modifications and variations.

What is claimed is:

1. A magazine sleeve, comprising: a fixing member, an adjusting member and a connecting rod; wherein the fixing member, is a sleeve case having a U-shaped cavity, and the magazine is received in the U-shaped cavity, and a notch of the adjusting member is disposed at an opening of the sleeve case, and an adjusting slide is disposed at the notch of the adjusting member, the adjusting slide is perpendicular to a back plate of the notch of the adjusting member, and a through hole is provided with a connecting rod on the back plate;

the adjusting member, is a U-shaped slot buckle plate which is located at the notch of the adjusting member; an elastic slide of the U-shaped slot buckle plate matches with the adjusting slide of the back plate, and the U-shaped slot buckle plate cooperates with the back plate to form an adjusting receiving cavity of the magazine; an elastic piece facing the back plate is arranged on the adjusting member, and a fastening adjusting hole corresponding to the through hole is provided at the U-shaped slot buckle plate;

the connecting rod, penetrates the through hole and the fastening adjusting hole to combine the adjusting member and the fixing member to form a receiving cavity of the magazine, and a distance between the adjusting member and the back plate is adjusted by adjusting an elastic thread fit of the connecting rod and fastening adjusting hole, the elastic piece is internal convex toward the back plate, and the distance between the adjusting member and the back plate is adjusted to make a magazine contained in the receiving chamber compressed or decompressed by the elastic piece.

2. The magazine sleeve according to claim 1, further comprising an elastic mechanism, wherein the elastic mechanism is located on the connecting rod between the fixing member and the adjusting member to provide elastic support facing the receiving cavity outwardly.

3. The magazine sleeve according to claim 2, wherein the elastic mechanism is a spring.

4. The magazine sleeve according to claim 1, wherein a slot is disposed outside the fixing member, and a buckle is disposed at a position outside the adjusting member and corresponding to the slot; the buckle is an internal convex elastic piece facing the receiving cavity, and a buckle tooth matching with the slot is disposed on an inner protrusion of the buckle; and the buckle cooperates with the slot to fix a position of the adjusting member and a position of the fixing member.

5. The magazine sleeve according to claim 4, wherein two or more slots are provided in a direction in parallel from the fixing member to the adjusting member.

6. The magazine sleeve according to claim 1, further comprising: a support plate and a fixing disc; wherein the fixing disc is disposed outside the back plate of the fixing member, and the fixing disc is a convex fluted disc provided with protruding teeth, and a groove is arranged between every two adjacent protruding teeth;

the convex fluted disc is disposed at a position where the support plate corresponds to the fixing disc, and the support plate and the fixing disc are connected by an adjusting rod, and the grooves are coupled with the protruding teeth to connect the fixing disc with the support plate together;

the adjusting rod between the support plate and the fixing disc is loosened, and the protruding teeth of the fixing disc are loosened from the grooves of the support plate to adjust a position of the fixing disc.

7. The magazine sleeve according to claim 1, wherein the fixing member comprises two or more U-shaped cavities; the adjusting member comprises two or more U-shaped slots, the adjusting member cooperates with the fixing member to form two or more receiving cavities of the magazine.

* * * * *